US005878529A

United States Patent [19]

Huber

[11] Patent Number: 5,878,529

[45] Date of Patent: Mar. 9, 1999

[54] ENTRANCE DEVICE

[75] Inventor: Jacob Robert Alfred Huber, Edam, Netherlands

[73] Assignee: Boon Edam B.V., Edam, Netherlands Antilles

[21] Appl. No.: 793,859

[22] PCT Filed: Aug. 3, 1994

[86] PCT No.: PCT/NL94/00181

§ 371 Date: Feb. 26, 1997

§ 102(e) Date: Feb. 26, 1997

[87] PCT Pub. No.: WO95/06183

PCT Pub. Date: Mar. 2, 1995

[30] Foreign Application Priority Data

Aug. 27, 1993 [NL] Netherlands ..... 9301485

[51] Int. Cl.[6] ..... E06B 7/00

[52] U.S. Cl. ..... 49/68; 109/8; 49/31

[58] Field of Search ..... 49/31, 42, 68; 109/67, 68, 6, 7, 8, 12, 13

[56] References Cited

U.S. PATENT DOCUMENTS

| | | | |
|---|---|---|---|
| 963,386 | 7/1910 | Parsons | 49/68 |
| 1,406,788 | 2/1922 | Weinmann | 49/42 X |
| 3,314,198 | 4/1967 | Frisk | 49/68 X |
| 3,766,844 | 10/1973 | Donnelly et al. | 49/68 X |
| 3,960,196 | 6/1976 | Berner | 160/22 |
| 4,565,030 | 1/1986 | LaSance | 49/31 X |
| 4,586,441 | 5/1986 | Zekich | 109/6 X |
| 5,012,455 | 4/1991 | Schwarz et al. | 439/31 X |
| 5,195,448 | 3/1993 | Sims | 49/42 X |
| 5,226,256 | 7/1993 | Fries et al. | 49/31 X |
| 5,694,867 | 12/1997 | Diaz-Lopez | 49/68 X |

FOREIGN PATENT DOCUMENTS

| | | | |
|---|---|---|---|
| 0 296 134 | 12/1988 | European Pat. Off. . | |
| 2 418 854 | 9/1979 | France . | |
| 4008121 | 4/1994 | WIPO | 49/68 |

*Primary Examiner*—Jerry Redman
*Attorney, Agent, or Firm*—Darby&Darby

[57] ABSTRACT

An entrance device for placement in a facade of a building includes at least two revolving doors. Each of the revolving doors has an input section and an output section. A sliding door provides closure of the input and output sections of the two revolving doors. The sliding door is disposed between the two revolving doors.

6 Claims, 1 Drawing Sheet

ENTRANCE DEVICE

BACKGROUND OF THE INVENTION

1. Field of the Invention

The invention relates to an entrance device according to the preamble of claim 1.

2. Description of the Prior Art

Such an entrance device is known from European patent application 0 296 134. This document discloses the application of a revolving door having at its output and input sections sliding doors designed to move in cooperation with the movement of the revolving door. The movement or position of the revolving door and the respective sliding doors can also be switched to independent operation whereby the revolving door is put in a stationary position in parallel with the passage through the revolving door assembly. The sliding doors may or may not move to and fro in their path in order to either provide a full and restricted passage or to provide a pure sliding door operation. In normal use, the entrance device of EP 0 296 134 requires a rather complicated cooperation of said sliding doors and the revolving door assembly.

SUMMARY OF THE INVENTION

It is the object of the invention to provide an entrance device according to the preamble of claim 1, having simpler operation and allowing for automatic switch over from one type of operation to the other depending on environmental conditions. In this way, high energy saving and optimal draft exclusion can be obtained in a first way of operation, whereas large capacity can be provided in a second type of operation.

The objectives of the invention can be obtained with the entrance device according to the preamble of claim 1, which is characterized in that the entrance device comprises two revolving doors and that the sliding door is arranged in the pathway between said two revolving doors.

In a certain aspect of the invention, the entrance device has a programmable control system including sensors for measuring environmental parameters, such as temperature, air humidity, wind speed or the like, to determine, on the basis thereof, the most convenient way of using the entrance means.

It is acknowledged that EP 0 296 134 discloses the use of a detector or similar sensing means to initiate a starting pulse for the drive motors that are used to operate the revolving door assembly and the sliding doors as disclosed in said publication. Such detector is, however, merely used to detect a person that is approaching the entrance device. It does not provide any means to identify the most convenient way of using the entrance means based on environmental conditions, such as temperature, air humidity and other weather conditions.

In a favourable embodiment of the entrance device according to the invention it also comprises an air treatment device and/or an air curtain. Such apparatus are known in the art but support the objective of the invention to provide energy saving and yet a high capacity entrance device depending on circumstances at hand.

According to the invention the entrance device can be adapted to environmental circumstances providing optimal comfort, a low energy use and a desired capacity, throughout the year. Preferably, the control system automatically switches to the most convenient manner of operation of the entrance device based on the measurements of the said environmental conditions. As an alternative the control system may be switched to semi-automatic operation whereby advice is given on the basis of the parameters measured by the sensors with regard to the most convenient operation under the measured circumstances.

BRIEF DESCRIPTION OF THE DRAWING

The invention will hereinafter be illustrated with reference to the drawings, which give a highly schematic representation of an exemplary embodiment of the invention.

DESCRIPTION OF THE PREFERRED EMBODIMENTS

Figure 1:
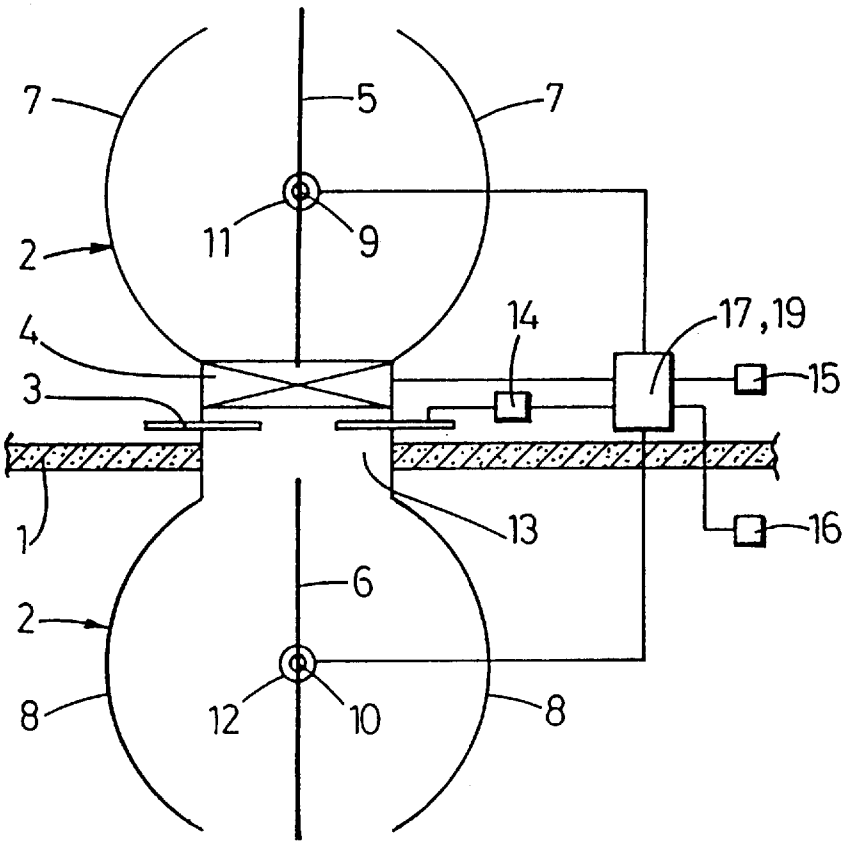
FIG. 1 is a highly schematic plan view of the embodiment of the entrance device according to the invention.

FIG. 1 shows an entrance device placed in an outer wall or facade of a building. In this exemplary embodiment, the entrance device comprises a revolving door lock 2, an automatic sliding door 3 and an air treatment device 4. The revolving door lock consists, in this case, of two revolving doors 5 and 6 which can each revolve about a vertical axis 9 and 10, respectively, within two casing walls 7 and 8, respectively, having the shape of a segment of a circle. Between both revolving doors 5, 6 of the revolving door lock 2, an intermediate part or corridor 13 is positioned, offering space to a sliding door 3 and an air treatment device 4 in its ceiling. The revolving doors 5, 6 each consist of two aligned door wings, which are provided on both sides of the axis 9, 10 concerned and which either constitute an integral unit or consist of separate parts. The revolving doors 5, 6 are driven by a synchronized driving device, which, in this case, consists of two electric motors 11, 12, which are synchronized electronically. In the normal operating mode, both revolving doors 5, 6 revolve synchronously, in such a way that the revolving doors 5, 6 are angularly offset 900 with respect to each other. As a result of this, the passage is always closed by at least one revolving door, so that the draught-preventing effect is guaranteed at all times. In the position represented in FIG. 1, the revolving door lock 2 is inoperative, the revolving doors 5, 6 being secured in alignment, parallel to the passage. Further details of this revolving door lock can be found in the earlier Dutch Patent No. 9201723, the content of which is incorporated herein by reference.

As mentioned before, an intermediate part is positioned between the revolving doors 5, 6, which houses an automatic sliding door including detection means (not represented) and a driving means 14. This sliding door may, as desired, close the entrance device, be secured in an opened position or function as an automatic sliding door. The sliding door may, instead of straight panels, also comprise sliding panels, which have the shape of a segment of a circle and which are adapted to the curvature of the casing walls 7, 8, and can therefore move on the outer side thereof.

The air treatment device 4, which, for example, consists of an air heater for heating the air coming from outside through the sliding door 3. The air treatment device 4 could be replaced by or supplemented with an air curtain, as is known in the art.

Figure 2:
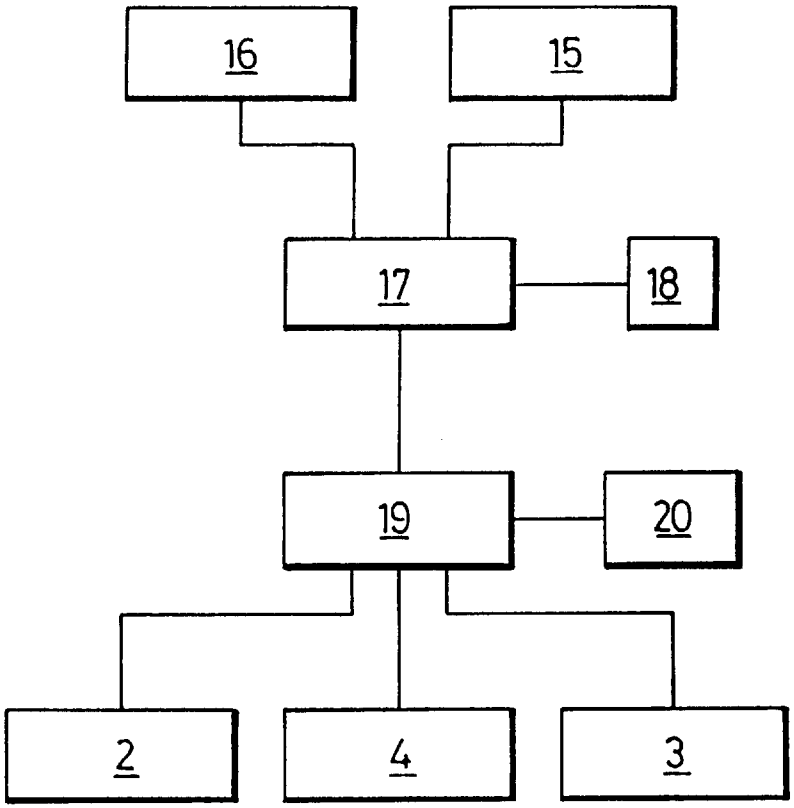
FIG. 2 shows a block diagram of the control system of the entrance device of FIG. 1.

According to the invention, the operation of the entrance device is controlled by a control system, as has been represented schematically in FIG. 1 and 2, which makes sure that the entrance device operates in the most optimal way for the environmental circumstances concerned, in particular the weather conditions. Thus, the entrance device will function as a revolving door in cold or windy weather. In a calmer type of weather, the revolving doors 5, 6 can be secured in the rest or summer position, and the sliding door 3 can be switched on, while in cold weather the air treatment device 4 can be switched on as well. When the weather is very fine, the entrance device can be opened completely.

In order to achieve this automatic operation, the control system comprises one or more indoor sensors 15 and a plurality of outdoor sensors 16. These sensors may, for example, consist of temperature gauges, hygrometers, wind gauges, pressure gauges (for measuring any pressure difference between the inside and the outside of the building) and possibly other sensors. These sensors 15, 16 are connected to a processing unit 17 including a display 18 for presenting data, such as the parameters measured. The processing unit is connected with a system control 19 having actuating elements 20 for influencing the system control from outside. The system control controls the revolving door lock 2, the sliding door 3 and the air treatment device 4. This control can be fully automatic, which means that the desired entrance mode is selected on the basis of the parameters measured and the data stored in the memory of the processing unit. Alternatively, the control system can be semi-automatic, giving an advice on the basis of the parameters measured as to what is the most optimal operating mode of the entrance device, which advice may, or may not, be followed by an operator and an adjustment may be made by way of the actuating elements 20. It is, of course, also possible to switch over completely to manual operation, and take no account of the parameters measured. A manager of a supermarket may, for example, still decide to use the sliding door in windy weather, when it is very busy and a large capacity is desired. The comfort and the energy saving effect may thus be sacrificed to some extent to that end.

It will be clear from the foregoing that the invention provides an entrance device which excels in versatility and user comfort.

The invention is not limited to the exemplary embodiment represented in the drawings and described in the foregoing, which can be varied in various ways within the scope of the invention. It is, for example, possible to replace the revolving door lock represented in the drawings by a single two, three or four-wing revolving door, in which former case the sliding door can be incorporated in the wings of the two-wing revolving door. The sliding door may be equipped with a one or two-sided escape facility to provide an emergency exit by flapping away the panels when pressure is exerted on the middle of the sliding door.

I claim:

1. An entrance device for placement in a facade of a building, comprising:

at least two revolving doors, each having an input section and an output section;

a sliding door for closure of the input and output sections of the two revolving doors, said sliding door being disposed between said two revolving doors; and an air curtain disposed between said two revolving doors.

2. The entrance device according to claim 1, which further comprises an air treatment device disposed between said two revolving doors.

3. The entrance device according to claim 1 having a programmable control system including sensors for measuring environmental parameters, such as temperature, air humidity, wind speed, to determine the most convenient way of using the entrance device.

4. The entrance device according to claim 3, in which the control system is semi-automatic and advice is given on the basis of the parameters measured by the sensors.

5. The entrance device according to claim 3, in which the control system is fully automatic and the operation of the entrance device is adjusted on the basis of the parameters measured by the sensors.

6. The entrance device according to claim 5, in which the fully automatic control system is switchable to semi-automatic or manual operation.

* * * * *